United States Patent [19]

Gargollo

[11] Patent Number: 4,850,739

[45] Date of Patent: Jul. 25, 1989

[54] METHOD AND APPARATUS FOR CONSTRUCTING AN ARTICULATED PAVEMENT SYSTEM

[76] Inventor: Roberto L. Gargollo, Alpes 650, Lomas de Chapultepec, 11000 Mexico City, Mexico

[21] Appl. No.: 148,714

[22] Filed: Jan. 26, 1988

[51] Int. Cl.[4] ..... E01C 5/00

[52] U.S. Cl. ..... 404/41; 156/71; 156/293; 156/303.1; 264/35; 264/263

[58] Field of Search ..... 404/17, 18, 29, 31, 404/32, 33, 34, 35, 37, 40-42, 45, 46; 52/612; 156/71, 293, 303.1; 428/60, 137; 264/35, 261, 263, 333

[56] References Cited

U.S. PATENT DOCUMENTS

| | | | |
|---|---|---|---|
| 708,471 | 9/1902 | Flood | 404/41 X |
| 1,379,440 | 5/1921 | Brainerd | 404/34 |
| 2,569,065 | 9/1951 | Lavin | 264/263 X |
| 3,030,951 | 4/1962 | Mandarino | 264/263 X |
| 3,522,618 | 8/1970 | Stranzinger | 404/41 X |
| 3,923,410 | 12/1975 | Jordan et al. | 404/41 |
| 4,018,025 | 4/1977 | Collette | 404/41 X |
| 4,465,398 | 8/1984 | Knudsen | 404/41 X |

FOREIGN PATENT DOCUMENTS

| | | | |
|---|---|---|---|
| 162712 | 4/1949 | Austria | 404/34 |
| 541652 | 10/1955 | Belgium | 404/41 |
| 2109971 | 9/1971 | Fed. Rep. of Germany | 404/41 |
| 2634586 | 11/1977 | Fed. Rep. of Germany | 404/41 |
| 2743317 | 4/1979 | Fed. Rep. of Germany | 404/41 |
| 3112608 | 10/1982 | Fed. Rep. of Germany | 404/41 |
| 1004695 | 4/1952 | France | 404/41 |
| 2551783 | 3/1985 | France | 404/41 |
| 667986 | 9/1964 | Italy | 404/41 |
| 1130171 | 10/1968 | United Kingdom | 404/41 |

*Primary Examiner*—Jerome W. Massie
*Assistant Examiner*—Bay Ann Spahn
*Attorney, Agent, or Firm*—Thomas E. Sisson

[57] ABSTRACT

A method and apparatus for constructing an articulating pavement comprising the placement in a first layer of a multiplicity of identically shaped foundation units on a subsurface. Each of the foundation units in the first layer is interlocked with adjacent foundation units in the first layer. Overlaid upon the first layer is a second layer of identical foundation units each of the foundation units in the second layer interlocked with adjacent units in the second layer. The units are shaped to create cavities between the first layer and second layer and between adjacent units in the first and second layers. Sufficient cement is then injected through orifices in the units to substantially fill the cavities. The cement is allowed to harden sufficiently to form latch pins which secure the units in an interlocked arrangement and articulatable in both the horizontal and vertical directions.

1 Claim, 4 Drawing Sheets

METHOD AND APPARATUS FOR CONSTRUCTING AN ARTICULATED PAVEMENT SYSTEM

BACKGROUND OF THE INVENTION

This invention relates to a method and apparatus for constructing a foundation or pavement. More specifically to a method and apparatus for providing for a pavement with the separate members having articulating joints therebetween such that when a load is placed on the separate members, the load is further distributed to adjacent members. The shape of the pavement or foundation sections yield a carpet-like distribution of the loads with the separate pieces having articulating and unbreakable joints.

It is well known that separate pieces of material may be utilized to form or create a foundation on an uneven surface. For example, the ancients utilized cobblestones and their variants to form roads and road foundations. Each stone was separate and not interlocking.

Subsequently, roadways and foundations were formed on uneven surfaces by the process of first generally flattening the area and then distributing across the generally flat area a multiplicity of layers of composite materials. Generally a layer of rock dust is laid down and a layer of rock is placed thereon. The layer of rock is rolled and compacted into the dust layer and then a second layer of dust is placed on the rock layer. Again, the material is rolled and compacted in an effort to form a relatively rigid and stable foundation or roadway.

One of the primary disadvantages in the existing foundation and roadway technology is that loads are not evenly distributed between the separate pieces of the foundation composite. Thus, when a load is particularly great on a given rock or piece of the foundation, there is no interconnection between the separate pieces so that the load is distributed to adjacent and surrounding connected pieces. Further, it is well known that erosion and temperature variations allow moisture to seep between the separate pieces and loosen them. As the loosened pieces experience excessive loads, the foundation or roadway is eventually destroyed.

The present method and apparatus is intended to avoid the disadvantages in the existing designs by providing separate pieces which are strong enough and at the same time flexible enough to move freely and to transmit to adjacent or surrounding pieces excessive loads. The instant method and apparatus utilizes the ability of the separate pieces to flex or articulate both horizontally and vertically to distribute the loads experienced by the separate pieces.

Further, the unique articulation joint which is formed between the various pieces insures that they do not separate once the pieces have been joined. Thus the present invention may be used to provide not only pavements for roadways, but also pavements or articulating surfaces for bridges, culverts, buildings, riverbeds, dams, etc.

SUMMARY OF THE INVENTION

The present invention is a method and apparatus for constructing an articulating pavement. A multiplicity of identical pavement units are placed as a first layer on a subsurface. Each of the individual pavement units in the first layer is then interlocked with adjacent pavement units in the first layer. Upon this first layer of pavement units, a second layer of identical foundation units is overlaid with each of the units in the second layer also interlocking with adjacent units in the second unit. Each of the pavement units is shaped to create cavities between the first and second layers and between adjacent units in the first and second layers. A fluid cement is injected through orifices in the units to substantially fill the cavities. After the cement has hardened, a latch pin is formed by the hardened cement. This latch pin secures the pavement units to adjacent units in both the first layer and the second layer. These layers are secured such that each of the pavement units remains interlocked and is articulatable in both the horizontal and vertical direction.

DETAILED DESCRIPTION OF THE PREFERRED EMBODIMENT

Figure 1:
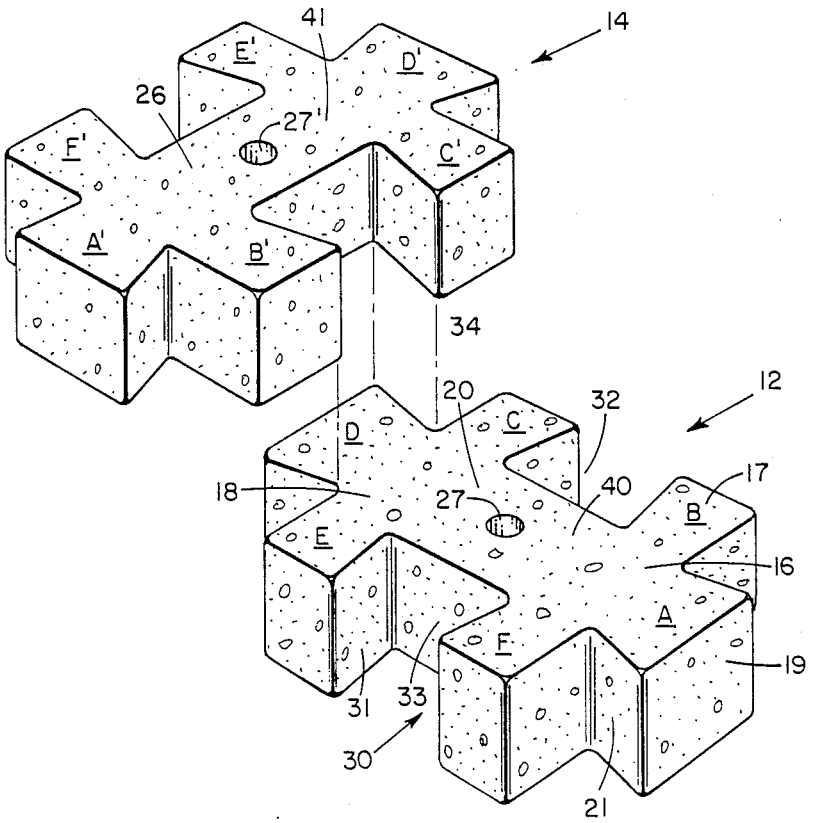
FIG. 1 is an exploded perspective view of one embodiment of one pavement unit interlocking with another pavement unit of the present invention.

FIG. 1 is an exploded perspective view which illustrates the interconnection of two identical pavement units 12 and 14 of the present invention. As can be seen in FIG. 1, pavement unit 12 consists of an upper T-shaped portion 16 and a lower T-shaped portion 18 joined by spanning portion 20. An orifice 27 extends completely through unit 12 at spanning portion 20. Upper T-shaped portion 16 further consists of end lobe A and side lobes B and F while lower T-shaped portion 18 consists of end lobe D and side lobes C and E. As can be seen with pavement unit 12, a lobe receiving space 32 is formed between side lobes B and C while lobe receiving space 3D is formed between side lobes F and E.

As can be seen in FIG. 1, receiving space 30 has a narrow neck receiving portion 31 furtherest from the spanning portion 20 and a wider head receiving portion 33 which is integral to spanning portion 20. Receiving space 30 is typical of all of the receiving spaces of each of the units of the present invention.

End lobe A shown in FIG. 1 is typical of all of the end lobes of the units of the present invention. End lobe A has a head portion 19 and a neck portion 21. Head portion 19 tapers from a wider width to a narrower width as it joins with neck portion 21. Extending generally perpendicularly to neck portion 21 on either side are shoulders 17 and 23. As will be described further herein, the head of each end lobe of a unit is interlocked within the lobe receiving space of an adjacent unit to form the articulating joint. Since the head of the end lobe is wider than the neck, and the receiving space is narrower at its neck receiving portion than at its head receiving portion, the end lobes will not pull away from an adjacent unit once they are engaged by sliding the head and neck into the receiving space from above or below.

In order to facilitate the discussion of the invention, each pavement unit will have identified a first flat surface and a second flat surface. The first flat surface on unit 12 is shown on the top and bears reference numeral 40. Unit 12 has its second flat surface on the bottom and cannot be seen in FIG. 1.

Pavement unit 14 is identical in all respects to pavement unit 12. Lobe A′ on pavement unit 14 corresponds to lobe A on unit 12. Likewise, lobes B′, C′, D′, E′, and F′ correspond to lobes B, C, D, E, and F on unit 12.

Figure 1A:
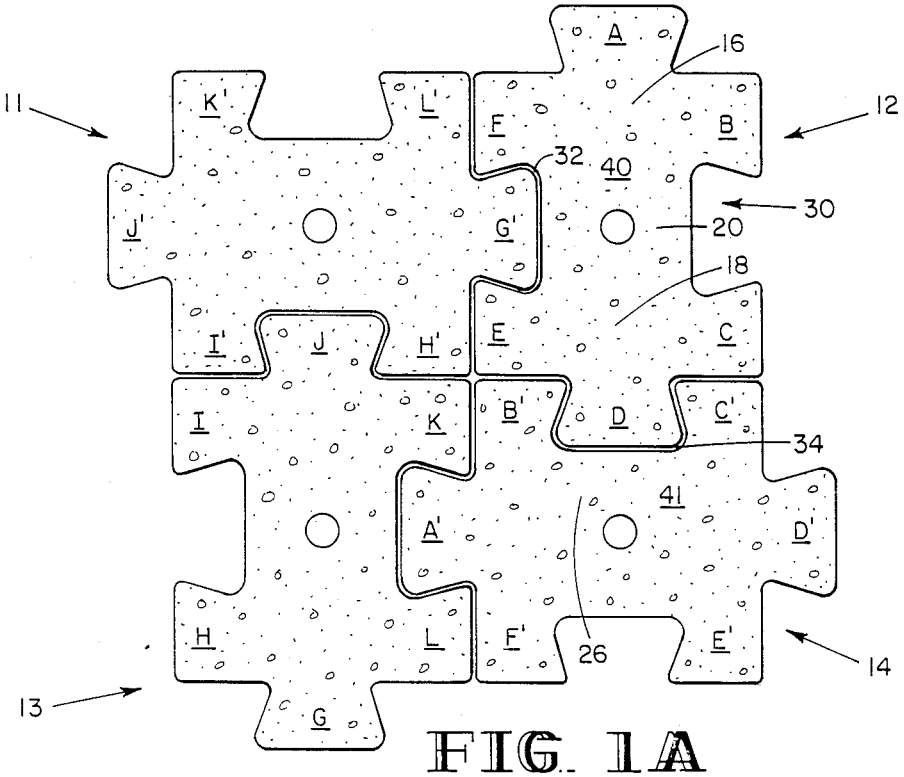
FIG. 1A is a top view of four interlocking pavement units of the present invention.

Because the units are substantially identical, when they are interlocked as shown in FIG. 1A, the separate pavement units 11, 12, 13 and 14 are held in a generally fixed spatial relationship. In FIG. 1A, lobe D of pavement unit 12 has been interlocked in lobe receiving space 34 formed in pavement unit 14 between lobe B′ and C′.

Thus, when a multiplicity of pavement units are interlocked over a subsurface, the side walls of one unit substantially abut with the side walls of another adjacent unit to form a load distribution joint. In FIG. 1A, such a joint is shown along the union of side lobe E of unit 12 with side lobe B′ of unit 14, along the junction of end lobe D of unit 12 with mid-portion 26 of unit 14, and along side lobe C of unit 12 and side lobe C′ of unit 14. These load distribution joints are articulatable in both the horizontal and vertical direction. There is approximately 3mm space between the units at each joint.

Because some articulation or flexing is capable at the joints, irregularities in the subsurface upon which the pavement units are placed are thereby compensated. When loads are placed on individual units, the load forces are distributed through the load distribution joints to adjacent foundation units.

It can be readily understood that a multiplicity of shapes and lobes can be designed to interlock to form a given articulating pavement.

Figure 2:
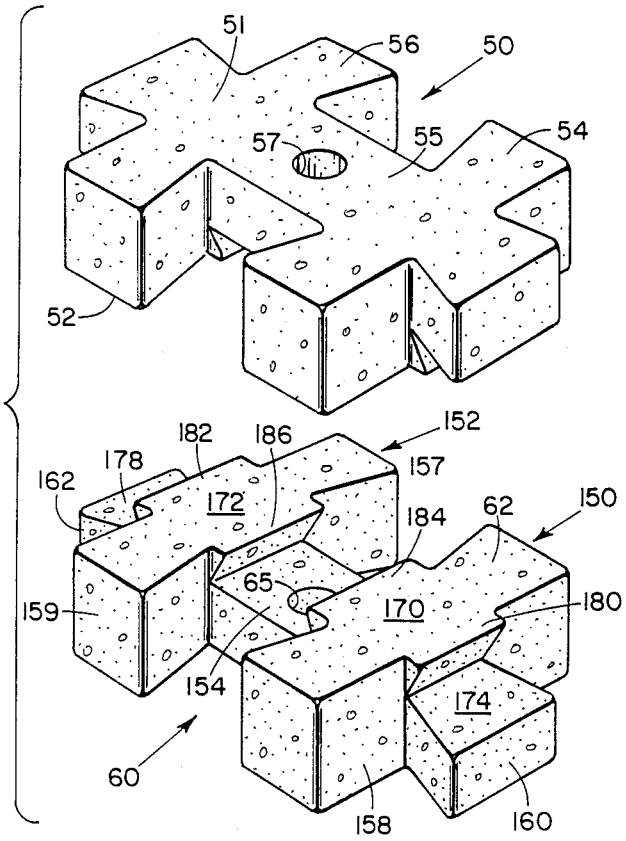
FIG. 2 is an exploded perspective view of two preferred embodiment pavement units of the present invention, one atop the other.

FIG. 2 illustrates an exploded perspective view of the preferred embodiment of the present invention wherein pavement unit 50 is identical to pavement unit 60 except that unit 60 has been flipped over in FIG. 2.

For explanation purposes, each unit can be understood to have a generally flat top side and a bottom side. In FIG. 2 unit 50 has a flat top side 51 and a bottom side 52. Unit 60 has been flipped over and its top side 61 is facing downwardly while its bottom side 62 is facing upwardly. As will be seen, the terms "top" and "bottom" are used for identification purposes and do not necessarily mean that on any given unit the "top" side will be facing upwardly and the "bottom" side will be facing downwardly.

As can be further noted in FIG. 2, unit 60 has an upper T-shaped portion 150 and a lower T-shaped portion 152 connected by spanning portion 154. While the top side 61 of unit 60 is generally flat and smooth, bottom side 62 has an uneven contour. The uneven contour is the result of raised and lowered sections designed to create cavities when the units are placed upon one another. On unit 60, the bottom side surfaces 170 and 172 of shoulder sections 156 and 158 and shoulder sections 157 and 159 are raised above the bottom side surfaces 174 and 178 of end lobes 160 and 162 and the bottom side surface 176 of spanning portion 154. Further, FIG. 2 illustrates the steps 180 and 182 slant inwardly from surface 170 to surface 174 and from surface 172 to surface 178. In the same way steps 184 and 186 slant inwardly from surface 172 to surface 176 and from surface 170 to surface 176. Inwardly slanting steps 180, 182, 184, and 186 result in the formation of cavities between the units when the units are interlocked or placed upon one another.

When the bottom side 52 of unit 50 is placed upon bottom side 62 of unit 60, layer cavity 73 (FIG. 2C) is formed as will hereinafter be described further. As can be seen in FIG. 2, pavement unit 50 has an orifice 57 in spanning member 55 connecting side lobes 54 and 56. When unit 50 is placed on top of unit 60 with surfaces 52 and 62 contacting each other, fluid cement may be pumped into orifice 57 to fill the cavities formed between the two foundation units.

Once the cement hardens a latch pin is formed. The formation of a latch pin results in securing the adjacent pavement units and allowing the units to remain interlocked yet articulatable in both the horizontal and vertical directions.

Figure 2A:
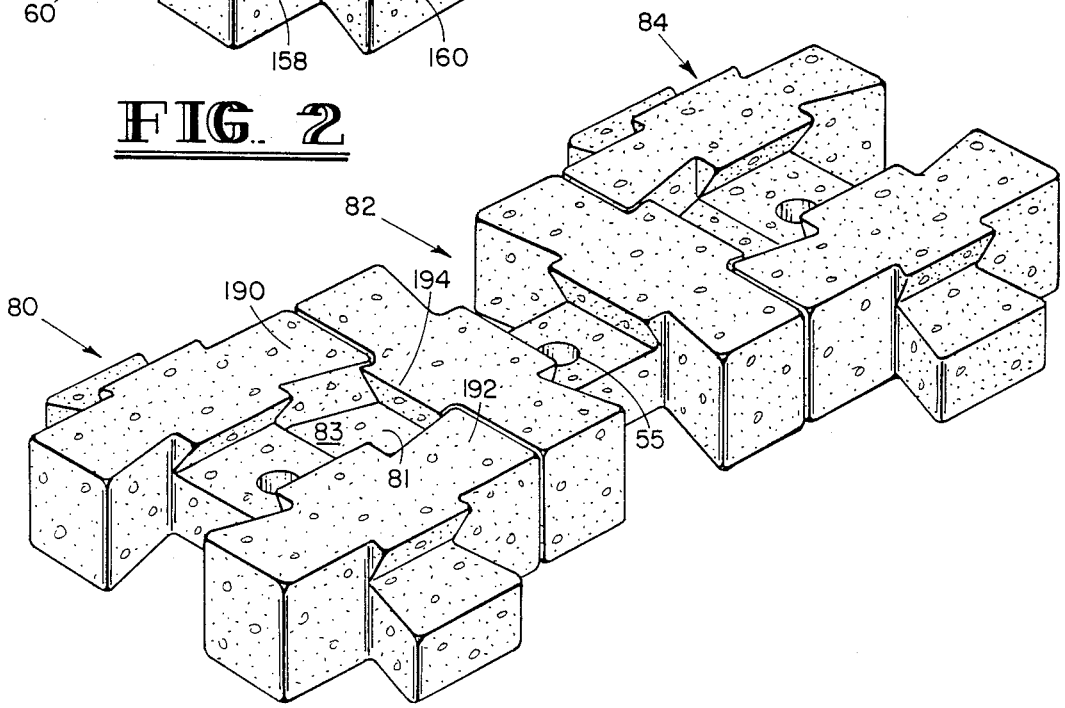
FIG. 2A is a perspective view of three of the pavement units of the present invention interlocked upon a subsurface.

In the construction of an articulating pavement of the present invention, a first layer of pavement units similar to unit 60 in FIG. 2 are individually placed on a subsurface. In FIG. 2A, unit 80 is placed on the subsurface and then is interlocked with unit 82 which is brought down against the subsurface. Next unit 84 is interlocked with unit 82 and brought down against the subsurface. Thus each of the units in this first layer are interlocked with adjacent units in the first layer as shown in FIG. 2A with the end lobes being received into the lobe receiving space.

End lobe 83 of unit 82 is shown in FIG. 2A interlocked in lobe receiving space 81 of unit 80. This is accomplished by bringing the head and neck of lobe 83 down from above and into lobe receiving space 81. It is clear that end lobe 83 cannot be otherwise interlocked in space 81 once unit 80 has been placed on the subsurface.

Figure 2B:
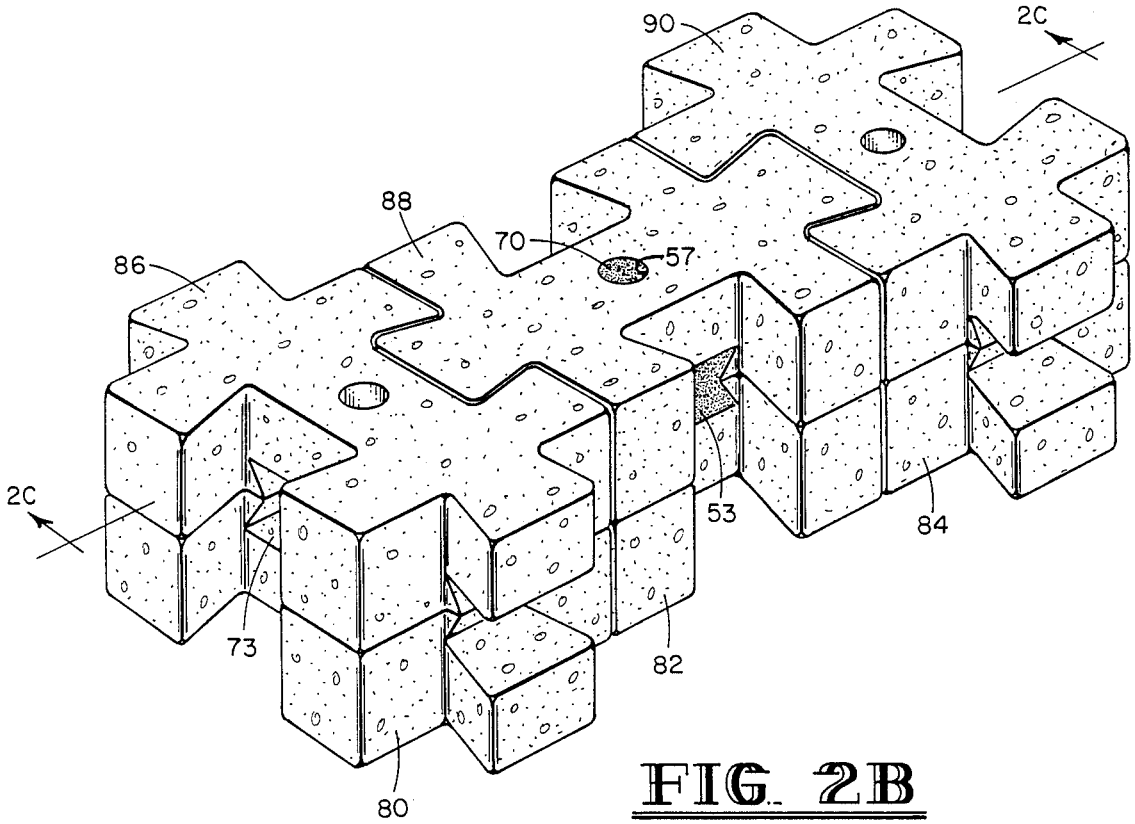
FIG. 2B is a perspective view of six of the pavement units of the present invention interlocked in two layers with a latch pin formed between two of the units.
Figure 2C:
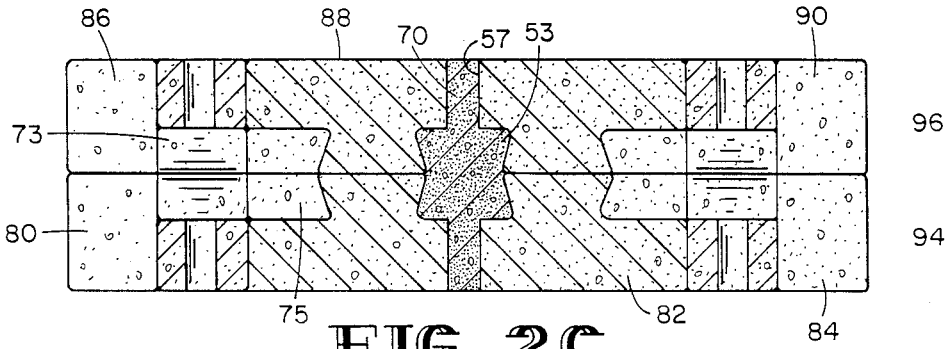
FIG. 2C is a cross sectional view taken along line 2C—2C of FIG. 2B.

Also, it will be noted in FIG. 2A that the interlocking of lobe 83 in lobe receiving space 81 results in the formation of adjacent cavity 75 between units 80 and 82 (see also FIG. 2C). This cavity 75 is formed between shoulder sections 190 and 192 of unit 80 and inwardly slanting step 194 of unit 82.

Upon the first layer of pavement units, is overlaid a second layer of identical units, each of the units in this second layer is interlocked with adjacent units in the second layer as can be seen in FIG. 2B. in FIG. 2B, units 86, 88, and 90 have been interlocked with each other and placed upon units 80, 82, and 84, As a result of the overlaying of the second layer upon the first layer, because of the configuration and shape of the pavement units, layer cavities (see layer cavity 73) are created between the first and second layer, as well as adjacent cavities (see adjacent cavity 75) being created between adjacent units in each of the first and second layers. Once the two interlocking layers are placed upon each other, sufficient fluid cement is injected through the orifices in the units to substantially fill the cavities between the units. After the cement has hardened sufficiently to form a latch pin 70, the units which are adjacent to one another both within the first and second layers are secured to each other thereby remaining interlocked and yet articulatable both in the horizontal and vertical directions. This articulation is possible because of the space between adjacent units at joints 200 and 202 which lie in the same horizontal plane or layer as shown in FIG. 2B. Overlaying units 88 and 82 are secured to each other by latch pin 70 and articulation or flexing of this multi-ply unit (88, 82, and 70) is capable at the joints 200 and 202. Irregularities in the subsurface upon which the units are placed are thereby compensated.

FIG. 2C is a cross sectional view of pavement units 80, 82, and 84 interlocked to form a first layer 94 and, units 86, 88, and 90 interlocked to form a second layer 96. Layer cavity 73 is shown as formed between first layer 94 and second layer 96. Adjacent cavity 75 is shown as formed between units 80, 82, 86, and 88. Further FIG. 2C shows latch pin 70 which results from the hardening of cement injected through orifice 57 in unit 88 and into layer cavity 53 between layers 94 and 96 and orifice 57 in unit 82 after the two layers 94 and 96 have been formed.

Figure 3A:
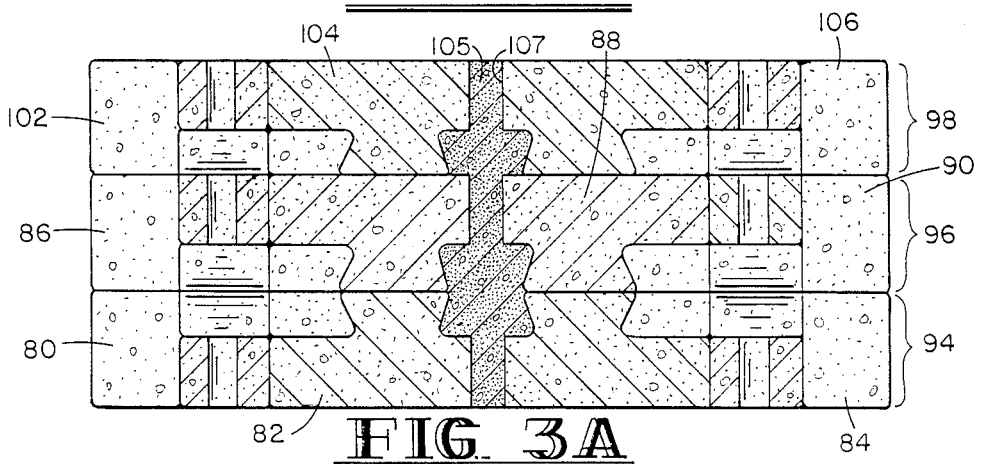
FIG. 3A is a cross sectional view taken along line 3A—3A of FIG. 3.
Figure 3:
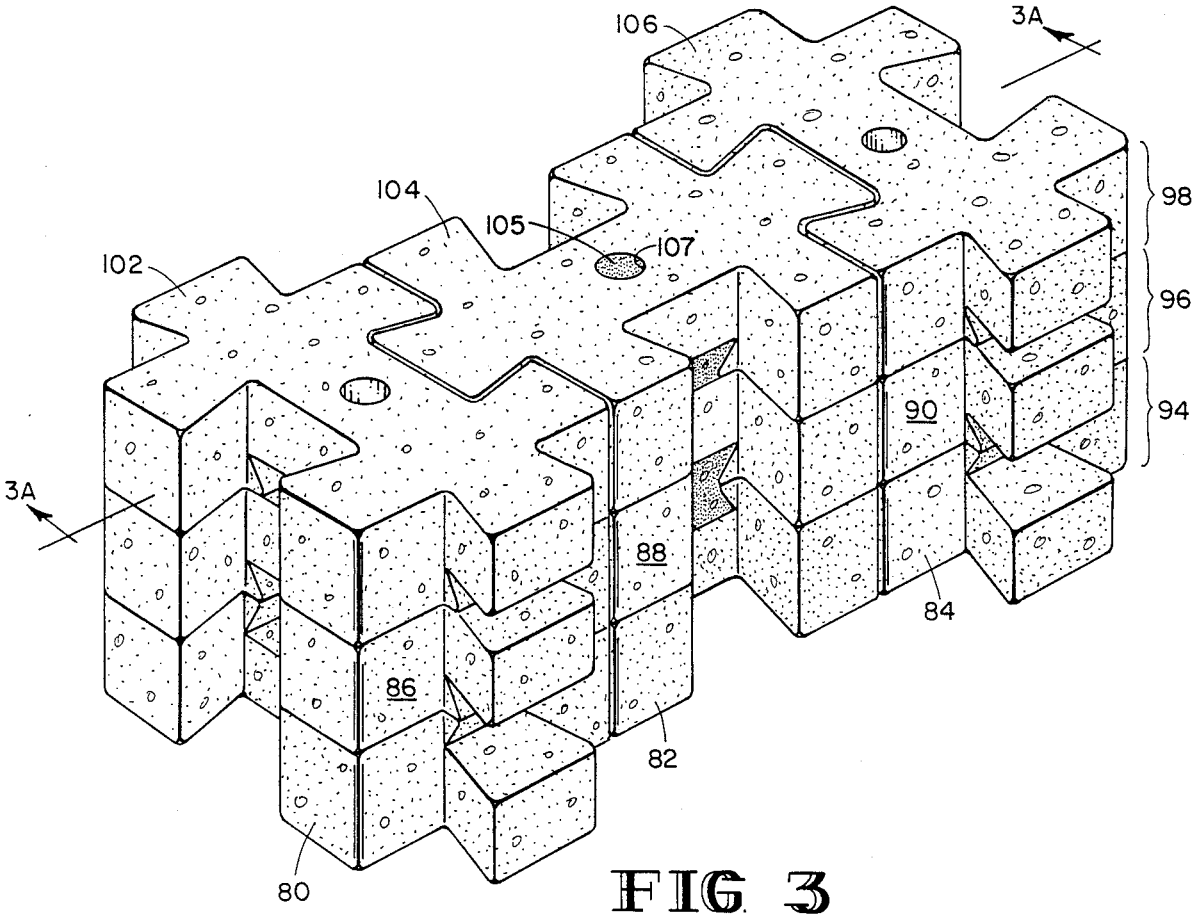
FIG. 3 is a perspective view of nine of the pavement units of the present invention interlocked in three layers with a latch pin formed between three of the units.

FIG. 3 illustrates a third layer 98 formed by the interlocking of units 102, 104, and 106 and their placement upon layer 96. Latch pin 105 is shown as resulting from the hardening of cement injected through orifice 107 in unit 104 and allowing it to flow between the interlocking units. Because there is space between adjacent units which lie in the same horizontal plane or layer at joints 204 and 206 in FIG. 3, articulation of the multi-ply unit (82, 88, 104, and 105) is possible. Thus three separate layers of interlocking units are formed which may articulate horizontally and vertically. FIG. 3A illustrates a cross sectional view showing nine units 80, 82, 84, 86, 88, 90, 102, 104, and 106 forming three layers 94, 96, and 98, with latch pin 105.

Figure 4:
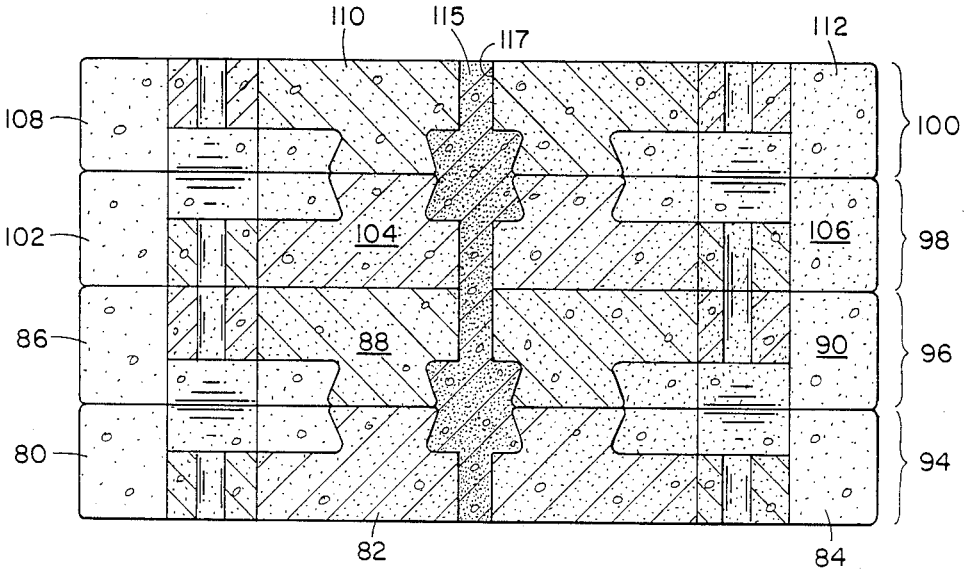
FIG. 4 is a cross sectional view of four of the pavement units of the present invention interlocked in four layers with a latch pin formed between the four units.

Should the need arise, the instant invention can result in the construction of a four layer arrangement shown in the cross sectional view of FIG. 4. Three additional units 108, 110, and 112 are shown interlocked to form layer 100 and latch pin 115 results from the injection of cement through orifice 117 in unit 110 which flows through layers 94, 96, 98, and 100 before it hardens.

Figure 5:
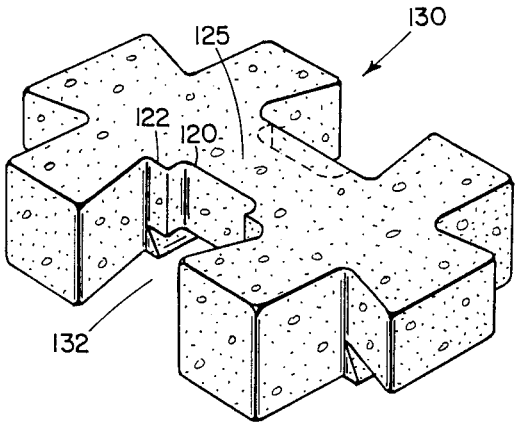
FIG. 5 is another alternative embodiment of the pavement units of the present invention with the injection orifice shown along one side wall of the spanning portion and optionally on two side walls as shown by the dotted lines.

An alternate embodiment of the pavement units of the present invention is shown in FIG. 5. Rather than the injection orifice being in the center of the spanning portion of each unit, the orifice is formed by placing a notch 120 in spanning portion 125 of unit 130. When an end lobe is received into lobe receiving space 132, an orifice is thereby formed between the end lobe and the head portion 122 of lobe receiving space 132. FIG. 5 also shows that the notch 120 could alternatively be placed on the other side of spanning portion 125 or even two notches placed in the spanning portion.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. A method of constructing an articulating surface comprising the steps of:

a. placing in a first layer a multiplicity of identically shaped foundation units on a subsurface;

b. interlocking each of said foundation units in said first layer with adjacent foundation units in said first layer with sufficient space between said first layer units to allow said first layer units to form load distribution joints articulatable in both the horizontal and vertical direction;

c. overlaying, upon said first layer, a second layer of said identical foundation units, each of said units in said second layer interlocking with adjacent units in said second layer with sufficient space between said second layer units to allow said second layer units to form load distribution joints articulatable to both the horizontal and vertical direction, said foundation units shaped to create cavities between overlaying units in said first layer and said second layer;

d. injecting through orifices in said units sufficient fluid cement to substantially fill said cavities;

e. hardening said cement sufficiently to form a latch pin securing said overlaying units in said first layer and said second layer to form an integral multi-ply unit, each of said multi-ply units remaining interlocked with adjacent multi-ply units, said multi-ply units articulatable in both the horizontal and vertical direction.

* * * * *